United States Patent [19]

Binversie et al.

[11] Patent Number: 5,044,599

[45] Date of Patent: Sep. 3, 1991

[54] COVER FOR TRANSOM BRACKET MOUNTING SCREWS

[75] Inventors: Gregory J. Binversie, Grayslake, Ill.; Joseph E. Capodarco, Kenosha, Wis.; James E. Macier, Beach Park, Ill.

[73] Assignee: Outboard Marine Corporation, Waukegan, Ill.

[21] Appl. No.: 515,824

[22] Filed: Apr. 27, 1990

[51] Int. Cl.[5] ..... B63H 21/26

[52] U.S. Cl. ..... 248/640; 440/53

[58] Field of Search ..... 248/682, 551, 640, 641, 248/642, 643, 300, 200; 411/374, 373, 372, 377, 429, 431, 910; 440/53, 900, 113

[56] References Cited

U.S. PATENT DOCUMENTS

| | | | |
|---|---|---|---|
| 1,994,978 | 3/1935 | Brown | 411/374 |
| 3,061,250 | 10/1962 | Conover | 440/53 |
| 3,241,427 | 3/1966 | Bosler | 411/374 |
| 3,548,704 | 12/1970 | Kutryk | 411/373 |
| 3,606,229 | 9/1971 | Wall | 248/200 |
| 3,943,877 | 3/1976 | Kemp | 248/643 |
| 4,239,172 | 12/1980 | Spitzmesser | 248/641 |
| 4,342,530 | 8/1982 | Baker | 411/374 |
| 4,763,871 | 8/1988 | Probst | 248/640 |
| 4,944,644 | 7/1990 | Bell | 411/372 |

FOREIGN PATENT DOCUMENTS

| | | | |
|---|---|---|---|
| 64-79000 | 3/1989 | Japan | 248/643 |

*Primary Examiner*—Ramon O. Ramirez
*Assistant Examiner*—Robert A. Olson
*Attorney, Agent, or Firm*—Michael, Best & Friedrich

[57] ABSTRACT

An apparatus for mounting an outboard motor on a boat transom, the apparatus comprising a transom bracket including an upper portion and a portion extending downwardly from the upper portion and having a surface adapted to engage the boat transom, means including a bolt member for releaseably clamping the downwardly extending portion to the boat transom, the bolt member including a portion extending outwardly from the surface of the downwardly extending portion, and a cover removeably fastened to the downwardly extending portion by screws to conceal the outwardly extending portion of the bolt member.

15 Claims, 1 Drawing Sheet

COVER FOR TRANSOM BRACKET MOUNTING SCREWS

BACKGROUND OF THE INVENTION

1. Field of the Invention

The invention relates to outboard marine motor transom mounting brackets, and, more particularly, to a cover for concealing parts of the transom bracket mounting screws which protrude from the surface of the transom bracket.

2. Reference to Prior Art

Outboard motors include a stern or transom bracket for mounting the outboard motor on the transom of a boat. While various clamping arrangements can be used to secure the transom bracket to the boat transom, among larger outboard motors, transom mounting screws or bolts are used to securely clamp the transom bracket to the boat transom. The screws or bolts extend through the boat transom and through the transom bracket and project outwardly from the surface of the transom bracket to receive washers, nuts, or other hardware.

Attention is directed to U.S. Pat. No. 4,763,871, which was issued to H. Probst, on Aug. 16, 1988.

SUMMARY

The invention provides an apparatus for mounting an outboard motor on a transom of a boat, the apparatus comprising a transom bracket including an upper portion and a portion extending downwardly from the upper portion and including a surface adapted to engage the boat transom, means adapted to extend through the boat transom, extending through the downwardly extending portion for releaseably clamping the transom bracket to the boat transom, and including a portion projecting outwardly from the downwardly extending portion, and a removable cover on the downwardly extending portion for concealing the outwardly projecting portion.

In one embodiment, the downwardly extending portion of the transom bracket includes a recessed surface and a flange, and the means for clamping includes a bolt member extending through the flange and having a portion extending in spaced relation to the recessed surface, the cover concealing the flange, the recessed surface, and the bolt member portion which extends over the recessed surface.

The invention also provides a cover for use on an outboard motor transom bracket releaseably clamped to the transom of a boat by a bolt member including a portion projecting outwardly from the transom bracket, the cover comprising a cover member for concealing the outwardly projecting portion of the bolt member, and means for removably fastening the cover member to the transom bracket.

The invention also provides a cover for an outboard motor transom bracket releaseably clamped to the transom of a boat by a bolt member including a portion projecting outwardly from the transom bracket, the cover comprising a cover member for concealing the outwardly projecting portion of the bolt member and including a flange portion, and means extending through the flange portion for releaseably fastening the cover member to the boat transom.

A principal feature of the invention is the provision of a cover for concealing the transom bracket mounting arrangement which includes, on the transom bracket, a mounting flange and an adjacent recessed surface, and a portion of a transom mounting bolt member which projects outwardly from the flange of the transom bracket.

Other features and advantages of the invention will become apparent to those skilled in the art upon review of the following detailed description, claims and drawings.

Figure 1:
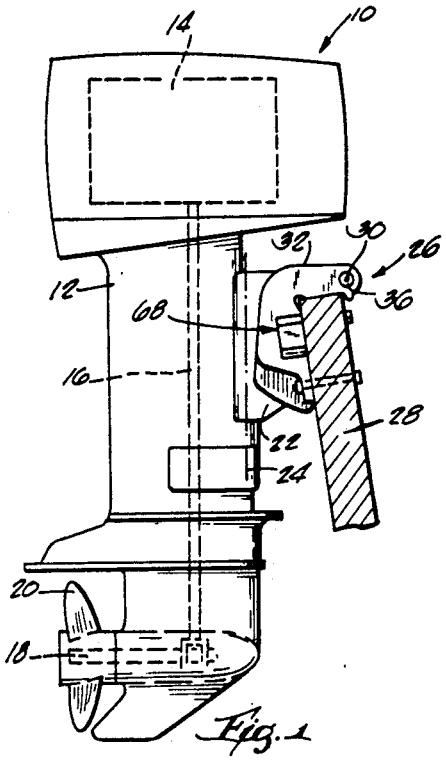
FIG. 1 is a side elevational view of a marine propulsion device incorporating a boat transom mounting bracket which embodies various of the features of the invention.
Figure 2:
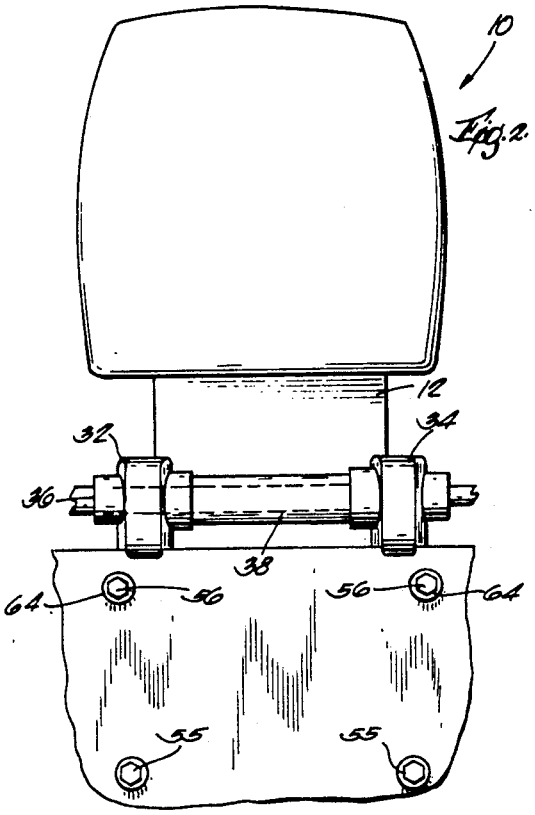
FIG. 2 is a front view of the marine propulsion device shown in FIG. 1.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

A marine propulsion device embodying various features of the invention is illustrated in the drawings. In the illustrated arrangement, the marine propulsion device is in the form of an outboard motor 10 including a propulsion unit 12 having an internal combustion engine 14. The engine 14 is drivingly coupled through a conventional drive train 16 to a propeller shaft 18 which is adapted to carry a propeller 20.

The propulsion unit 12 is mounted on a swivel bracket 22 for pivotal movement relative thereto about a generally vertical steering axis 24. The swivel bracket 22 is supported by an apparatus 26 for removably mounting the outboard motor 10 on the transom 28 of a boat, the swivel bracket 22 being pivotable relative to the mounting apparatus 26 about a generally horizontal tilt axis 30.

The mounting apparatus 26 includes a pair of transom brackets 32 and 34 interconnected by a pivot pin 36 extending through a sleeve portion 38 of the swivel bracket 22. While in the illustrated arrangement a pair of transom brackets 32 and 34 are employed, in other arrangements, a single transom bracket can be employed. Although each of the transom brackets 32 and 34 may have an arrangement different from that of the other, in the disclosed construction the transom brackets 32 and 34 are substantially identical, except for being mirror images of each other, and only transom bracket 32 will be described in detail.

Figure 6:
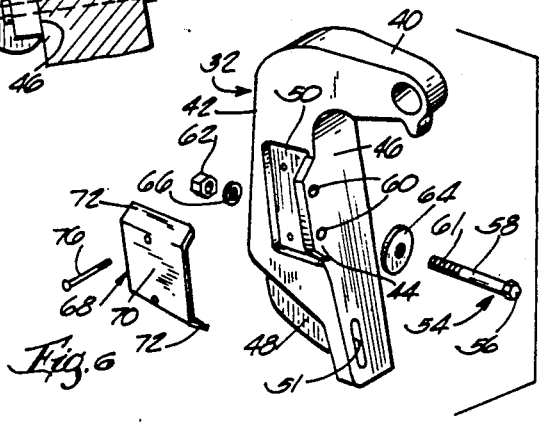
FIG. 6 is a perspective view of the transom mounting bracket shown in FIG. 3.

As shown most clearly with reference to FIG. 6, the transom bracket 32 is preferably an integral unit, and includes an upper portion 40 which can be adapted to rest on the top of the boat transom 28, and a portion 42 extending downwardly from the upper portion 40. The downwardly extending portion 42 includes a flange 44 which is provided with a series of mounting holes 60. In addition, the downwardly extending portion includes a surface 46 adapted to engage the outside surface of the boat transom 28, an outer surface 48, and a recessed surface 50 spaced from the outer surface 48. Furthermore, the downwardly extending portion 42 has therein (see FIG. 6) a slot 51, the reason for which is explained below.

The mounting apparatus 26 is provided with means for releaseably clamping the transom bracket 32 to the boat transom 28. While various suitable means for clamping can be employed, in the illustrated arrangement, the means for clamping include one or more conventional screw or bolt members. In the illustrated arrangement, an upper bolt member 54 and a lower bolt member 55 are used to clamp the transom bracket 32 to the boat transom 28. The lower bolt member 55 extends through the slot 51 and through the transom 28.

Figure 3:
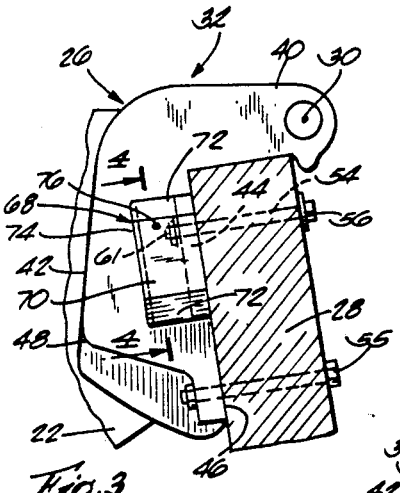
FIG. 3 is a side view of the transom bracket shown in FIG. 1.
Figure 4:
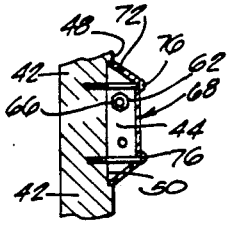
FIG. 4 is a view taken along line 4—4 in FIG. 3.
Figure 5:
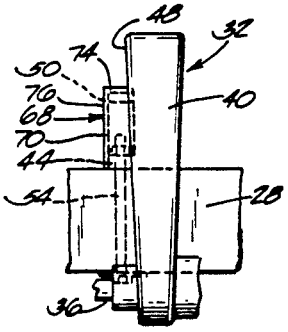
FIG. 5 is a top view of the transom bracket shown in FIG. 3.

As shown most clearly in FIGS. 3 and 6, the upper bolt member 54 includes a head 56 for bearing engagement against the boat transom 28, and a shank portion 58 having a part adapted to extend through the boat transom 28, a part extending through a mounting hole 60 in the flange 44, and a threaded end portion 61 projecting outwardly from the transom bracket 32 and in spaced relation to the recessed surface 50. The recessed surface 50 provides clearance between the threaded end portion 61 of the bolt member 54 and the transom bracket 32 so that a nut 62 can be threaded on to the bolt member 54. The clearance provided is also preferably sufficient to allow the use of a wrench or other tool to securely tighten the nut 62 on the bolt member 54, so that the surface 46 firmly bears against the boat transom 28. A first washer 64 can be used between the bolt head 56 and the boat transom 28, and a second washer 66 can be used between the nut 62 and the transom bracket 32.

The transom bracket 32 is provided with a cover 68 for hiding from view the bolt end 61, nut 62 and washer 66. The provision of a cover 68 to conceal unsightly hardware extending outwardly from the transom bracket 32 makes the mounting apparatus 26 more aesthetically pleasing, and gives a boat and a motor mounted thereon a cleaner, more integrated look.

Although the cover 68 may have various configurations, in the illustrated arrangement the cover 68 includes a cover or top portion 70, a pair of leg portions 72 and a back portion 74. Each of the leg portions 72 and the back portion 74 preferably has a bottom edge which is adapted to engage the transom bracket 32 to space the top portion 70 from the transom bracket 32. In the illustrated arrangement, the cover 68 is adapted to enclose the flange 44 and the bottom edges of the leg portions 72 and back portion 74 are adapted to engage the recessed surface 50 so that the entire transom mounting screw area including the flange 44 and the recessed surface 50 is substantially concealed by the cover 68.

The cover 68 is provided with means for removeably fastening the cover to the transom bracket 32. While various means for fastening can be employed, in the illustrated arrangement, the means for fastening includes screws 76. The screws 76 are preferably made of plastic, and both the cover 68 and the screws 76 are preferably of the same color as the transom bracket 32 to camouflage the cover 68 and screws 76 so that the smooth, integrated look of the boat and motor is not interrupted. The leg portions 72 and back portion 74 support the top portion 70 to prevent buckling of the top portion 70 when the screws 76 are tightened.

Figure 7:
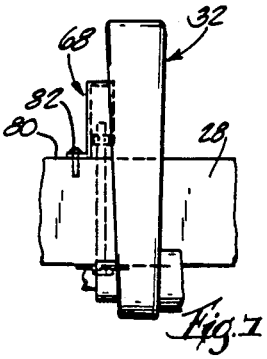
FIG. 7 is a top view similar to FIG. 5, and showing an alternative embodiment of the transom bracket.

In the illustrated arrangement the cover 68 is fastened to the transom bracket 32 by screws 76. In an alternative embodiment illustrated in FIG. 7, the cover can include a flange member 80 adapted to engage the boat transom 28, and means such as screws 82 can be employed to releaseably fasten the cover 68 to the boat transom 28.

In addition to making the mounting apparatus 26 more appealing to the eye, the cover 68 also provides other advantages associated with covers in general.

Various features of the invention are set forth in the following claims.

We claim:

1. An apparatus for mounting an outboard motor on a transom of a boat, said apparatus comprising a transom bracket including an upper portion and a portion extending downwardly from said upper portion and including a flange, and a surface adapted to engage the boat transom, means which is adapted to extend through the boat transom, which extends through said flange for releaseably clamping said transom bracket to the boat transom, and which includes a portion projecting outwardly from said downwardly extending portion, and a removeable cover which is located on said downwardly extending portion, which conceals said outwardly projecting portion, and which conceals the entirety of said flange.

2. An apparatus as set forth in claim 1, wherein said means includes a shank portion having a first subpart adapted to extend through the boat transom, a second subpart extending through said flange, and a third subpart forming at least part of said outwardly projecting portion.

3. An apparatus as set forth in claim 1, wherein said cover includes a top portion and a leg portion extending from said top portion for spacing said top portion from said transom bracket, said leg portion having an end adapted to engage said transom bracket.

4. An apparatus as set forth in claim 3, wherein said downwardly extending portion includes an outer surface extending transversely to said flange and having therein a recess defined in part by a recessed surface spaced from said outer surface, and wherein said third subpart extends in spaced relation to said recessed surface.

5. An apparatus as set forth in claim 4, wherein said cover extends into said recess.

6. An apparatus as set forth in claim 4 and furthering comprising means for releaseably fastening said cover to said transom bracket.

7. An apparatus as set forth in claim 6, wherein said cover is fastened to said recessed surface.

8. An apparatus for mounting an outboard motor on a transom of a boat, said apparatus comprising a transom bracket including an upper portion and a portion extending downwardly from said upper portion and including a flange, a surface adapted to engage the boat transom, and an outer surface extending transversely to said flange and having therein a recess defined in part by a recessed surface spaced from said outer surface, means which is adapted to extend through the boat transom, which extends through said flange for releaseably clamping said transom bracket to the boat transom, and which includes a shank portion having a first subpart adapted to extend through the boat transom, a second subpart extending through said flange, and a third subpart projecting outwardly from said downwardly extending portion and extending in spaced relation to said recessed surface, and a removeable cover which is located on said downwardly extending portion, which conceals said outwardly projecting portion, which conceals said flange, and which includes a top portion and a leg portion extending from said top portion for spacing said top portion from said transom bracket, said leg portion having an end, said end of said leg portion engaging said recessed surface.

9. An apparatus for mounting an outboard motor on a transom of a boat, said apparatus comprising a transom bracket including an upper portion, and a portion extending downwardly from said upper portion and including a flange, an outer surface extending transversely to said flange, and having therein a recess defined in part by a recessed surface spaced from and generally parallel to said outer surface, and a third surface adapted to engage the boat transom, means for releaseably clamping said transom bracket to the boat transom and including a bolt member having a shank portion including a first subpart adapted to extend through the boat transom, a second subpart extending through said flange, and a third subpart projecting outwardly from said transom bracket and extending in spaced relation to said recessed surface, a removable cover concealing said flange and including a cover portion for concealing said third subpart, and a leg portion depending from said cover portion for spacing said cover portion from said transom bracket, said leg portion including an end engaging said recessed surface, and means for removeably fastening said cover to one of said outer surface and said recessed surface.

10. An apparatus as set forth in claim 9, wherein said cover is fastened to said recessed surface.

11. An apparatus as set forth in claim 9, wherein said cover is completely spaced from said clamping means.

12. An apparatus for mounting an outboard motor on a transom of a boat, said apparatus comprising a transom bracket including an upper portion, and a portion extending downwardly from said upper portion and including a flange, an outer surface extending transversely to said flange and having therein a recess defined in part by a recessed surface spaced from said outer surface, and a surface adapted to engage the boat transom, means for releaseably clamping said transom bracket to the boat transom and including a member which is adapted to extend through the boat transom and through said flange, and which includes a portion projecting outwardly from said flange and extending in spaced relation to said recessed surface, and a removable cover which conceals said member portion and which extends into said recess.

13. An apparatus as set forth in claim 12 wherein said cover is fastened to said recessed surface.

14. An apparatus for mounting an outboard motor on a transom of a boat, said apparatus comprising a transom bracket including an upper portion, and a portion extending downwardly from said upper portion and including a flange, a second surface extending transversely to said flange, and a third surface adapted to engage the boat transom, means for releaseably clamping said transom bracket to the boat transom and including a member which is adapted to extend through the boat transom and through said flange, and which includes a portion projecting outwardly from said flange, a removable cover for concealing said member portion, and means for removeably fastening said cover to said second surface.

15. An apparatus as set forth in claim 14 wherein said second surface has therein a recess, and wherein said cover extends into said recess.

* * * * *